US009634441B2

(12) United States Patent
Kim et al.

(10) Patent No.: US 9,634,441 B2
(45) Date of Patent: Apr. 25, 2017

(54) HIGH VOLTAGE CONNECTOR FOR VEHICLE

(71) Applicants: Hyundai Motor Company, Seoul (KR); Yura Corporation Co., Ltd., Seongnam, Gyeonggi-do (KR)

(72) Inventors: Seok Min Kim, Incheon (KR); Myoung Kun Roh, Gyeonggi-do (KR)

(73) Assignees: Hyundai Motor Company, Seoul (KR); Yura Corporation Co., Ltd., Seongnam, Gyeonggi-do (KR)

( * ) Notice: Subject to any disclaimer, the term of this patent is extended or adjusted under 35 U.S.C. 154(b) by 0 days.

(21) Appl. No.: 14/936,749

(22) Filed: Nov. 10, 2015

(65) Prior Publication Data

US 2017/0062996 A1 Mar. 2, 2017

(30) Foreign Application Priority Data

Aug. 26, 2015 (KR) ..... 10-2015-0120035

(51) Int. Cl.
*H01R 13/62* (2006.01)
*H01R 13/707* (2006.01)

(52) U.S. Cl.
CPC ..... *H01R 13/707* (2013.01); *H01R 2201/26* (2013.01)

(58) Field of Classification Search
CPC ..... H01R 13/62938; H01R 13/22; H01R 13/62933; H01R 13/6272; H01R 13/2421
USPC ..... 439/157, 289, 310, 352, 372, 700, 824
See application file for complete search history.

(56) References Cited

U.S. PATENT DOCUMENTS

| | | | | |
|---|---|---|---|---|
| 4,810,202 | A * | 3/1989 | Nodfelt | H01R 13/523 439/132 |
| 5,529,510 | A * | 6/1996 | Wakata | H01R 13/2421 439/310 |
| 6,935,881 | B2 * | 8/2005 | Kainz | B61G 5/10 439/135 |
| 6,981,887 | B1 * | 1/2006 | Mese | H01R 24/62 439/244 |
| 7,650,942 | B2 * | 1/2010 | Abbey | E21B 33/0385 166/338 |
| 7,789,690 | B1 | 9/2010 | Rhein | |
| 8,911,260 | B2 * | 12/2014 | Golko | H01R 13/6581 439/108 |
| 9,033,723 | B2 | 5/2015 | Jeong et al. | |
| 2012/0238124 | A1 | 9/2012 | Zhao | |

FOREIGN PATENT DOCUMENTS

| | | |
|---|---|---|
| JP | 2004-082830 A | 3/2004 |
| JP | 2014-512065 A | 5/2014 |
| KR | 10-0790339 | 1/2008 |

(Continued)

*Primary Examiner* — Thanh Tam Le
(74) *Attorney, Agent, or Firm* — Mintz Levin Cohn Ferris Glovsky and Popeo, P.C.; Peter F. Corless

(57) ABSTRACT

A high voltage connector for a vehicle includes: a first connector connected to a first wire to transfer a current and including an interlock switch part controlling an interlock signal to open or close a voltage transfer; and a second connector connected to a second wire to transfer a current and including a pressing part pressing a portion of the interlock switch part of the first connector to control the opening or closing of the voltage transfer of the interlock switch part.

11 Claims, 10 Drawing Sheets

(56) References Cited

FOREIGN PATENT DOCUMENTS

| | | | |
|---|---|---|---|
| KR | 10-2011-0037217 | | 4/2011 |
| KR | 10-2012-0046796 | A | 5/2012 |
| KR | 10-2012-0120810 | | 11/2012 |
| KR | 10-2013-0033102 | | 4/2013 |
| KR | 10-1446531 | B1 | 11/2014 |
| KR | 10-2015-0005235 | A | 1/2015 |

* cited by examiner

HIGH VOLTAGE CONNECTOR FOR VEHICLE

CROSS-REFERENCE TO RELATED APPLICATION

This application claims the benefit of and priority to Korean Patent Application No. 10-2015-0120035, filed on Aug. 26, 2015 in the Korean Intellectual Property Office, the disclosure of which is incorporated herein in its entirety by reference.

TECHNICAL FIELD

The present disclosure relates generally to a high voltage connector for a vehicle and, more particularly, to a high voltage connector for a vehicle capable of enabling an interlock structure.

BACKGROUND

Generally, in a connector assembly, a first connector and a second connector are connected to each other to perform electrical connection. That is, the first and second connectors include terminals each disposed in housings configuring appearances, respectively, and the terminals are electrically connected to each other to form an electrical connection.

Recently, in accordance with the development of vehicles using a motor other than an engine as a driving source, the case in which connectors used in vehicles are used at a high voltage has increased. When using a high voltage connector, a spark is generated at the moment in which the first and second connectors are disconnected from each other, such that risks such as fire, and the like, occur.

In order to solve the problems as described above, it is necessary to continuously monitor that conduction is released and a connection in a circuit form is made before a physical connection between the terminals of the first and second connectors is released.

In an environmentally friendly vehicle using the high voltage connector, as described above, a connector to which an interlock structure, which is a current pre-blocking device, is applied has been used for the purpose of safety. Here, the connector requires a female connector including an interlock terminal having a spring structure in order to open or close the interlock structure in a circuit form. Therefore, the interlock structure may be disposed in the vicinity of a large current to have an influence on an electromagnetic wave, and a size thereof is increased.

SUMMARY

The present disclosure has been made to solve the above-mentioned problems occurring in the related art while advantages achieved by the related art are maintained intact.

An aspect of the present disclosure provides a high voltage connector for a vehicle capable of enabling an interlock structure using a switch for discriminating an interlock signal and a structure for pressing the switch without forming a separate interlock terminal in a female connector.

According to embodiments of the present disclosure, a high voltage connector for a vehicle includes: a first connector connected to a first wire to transfer a current and including an interlock switch part controlling an interlock signal to open or close a voltage transfer; and a second connector connected to a second wire to transfer a current and including a pressing part pressing a portion of the interlock switch part of the first connector to control the opening or closing of the voltage transfer of the interlock switch part.

The first connector may include a first current terminal and a second current terminal that are disposed in a housing and transfer the current, and the interlock switch part is disposed between the first current terminal and the second current terminal.

The second connector may include a first current connecting bar and a second current connecting bar contacting the first current terminal and the second current terminal.

The interlock switch part may include: a switch body connected to the first wire; a switch rod provided at a front end of the switch body so as to be movable by the pressing part of the second connector; and a coil spring connecting the switch body and the switch rod to each other.

The front end of the switch body may be provided with an interlock terminal transferring a voltage of the first wire and a rear end of the switch rod may be provided with a short spring terminal into which the interlock terminal is selectively inserted, such that an interlock circuit is not operated when the interlock terminal is inserted into the short spring terminal and the interlock circuit is operated when the interlock terminal is not inserted into the short spring terminal.

The short spring terminal may have a shape of a leaf spring folded to have a predetermined gap, one end of the short spring terminal may be fixed to the switch rod, and another end of the short spring terminal may be opened to correspond to the interlock terminal.

A catching part may be formed at a folded portion of the short spring terminal in order to prevent the short spring terminal from being separated from the switch rod.

The short spring terminal may include: a spring part elastically contacting the interlock terminal so as to correspond to the interlock terminal; a deformation preventing part preventing deformation of the spring part; and a cover formed outside of the spring part so as to protect the spring part.

A catching groove may be formed in the pressing part to correspond to a switch rod.

Furthermore, according to embodiments of the present disclosure, a high voltage connector for a vehicle includes: a first connector including an interlock switch part, a first current terminal, and a second current terminal, the first current terminal and the second current terminal being disposed in a housing and transferring a current, the interlock switch part including a switch body connected to a first wire, controlling an interlock signal to open or close a voltage transfer, and being disposed between the first current terminal and the second current terminal, wherein a switch rod is provided at a front end of the switch body so as to be movable, and a coil spring connects the switch body and the switch rod to each other; and a second connector connected to a second wire to transfer a current and including a first current connecting bar, a second current connecting bar, and a pressing part pressing a portion of the interlock switch part of the first connector to control the opening or closing of the voltage transfer of the interlock switch part, the first current connecting bar and the second current connecting bar contacting the first current terminal and the second current terminal.

The front end of the switch body may be provided with an interlock terminal transferring a voltage of the first wire and a rear end of the switch rod may be provided with a short spring terminal into which the interlock terminal is selectively inserted, such that an interlock circuit is not operated when the interlock terminal is inserted into the short spring terminal and the interlock circuit is operated when the interlock terminal is not inserted into the short spring terminal.

The short spring terminal may have a shape of a leaf spring folded to have a predetermined gap, one end of the short spring terminal may be fixed to the switch rod, and another end thereof may be opened to correspond to the interlock terminal.

A catching part may be formed at a folded portion of the short spring terminal in order to prevent the short spring terminal from being separated from the switch rod.

The short spring terminal may include: a spring part elastically contacting the interlock terminal so as to correspond to the interlock terminal; a deformation preventing part preventing deformation of the spring part; and a cover formed outside of the spring part so as to protect the spring part.

Furthermore, according to embodiments of the present disclosure, a high voltage connector for a vehicle includes: a first connector including a first current terminal and a second current terminal serving as a path of a current; and a second connector including a first current connecting bar and a second current connecting bar connected to the first current terminal and the second current terminal, detachably connected to the first connector, and including a pressing part protruding toward the first connector, wherein the first connector is provided with an interlock switch part formed between the first current terminal and the second current terminal and moving by the pressing part to open or close a voltage transfer of the first current terminal and the second current terminal.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF THE EMBODIMENTS

Figure 1:
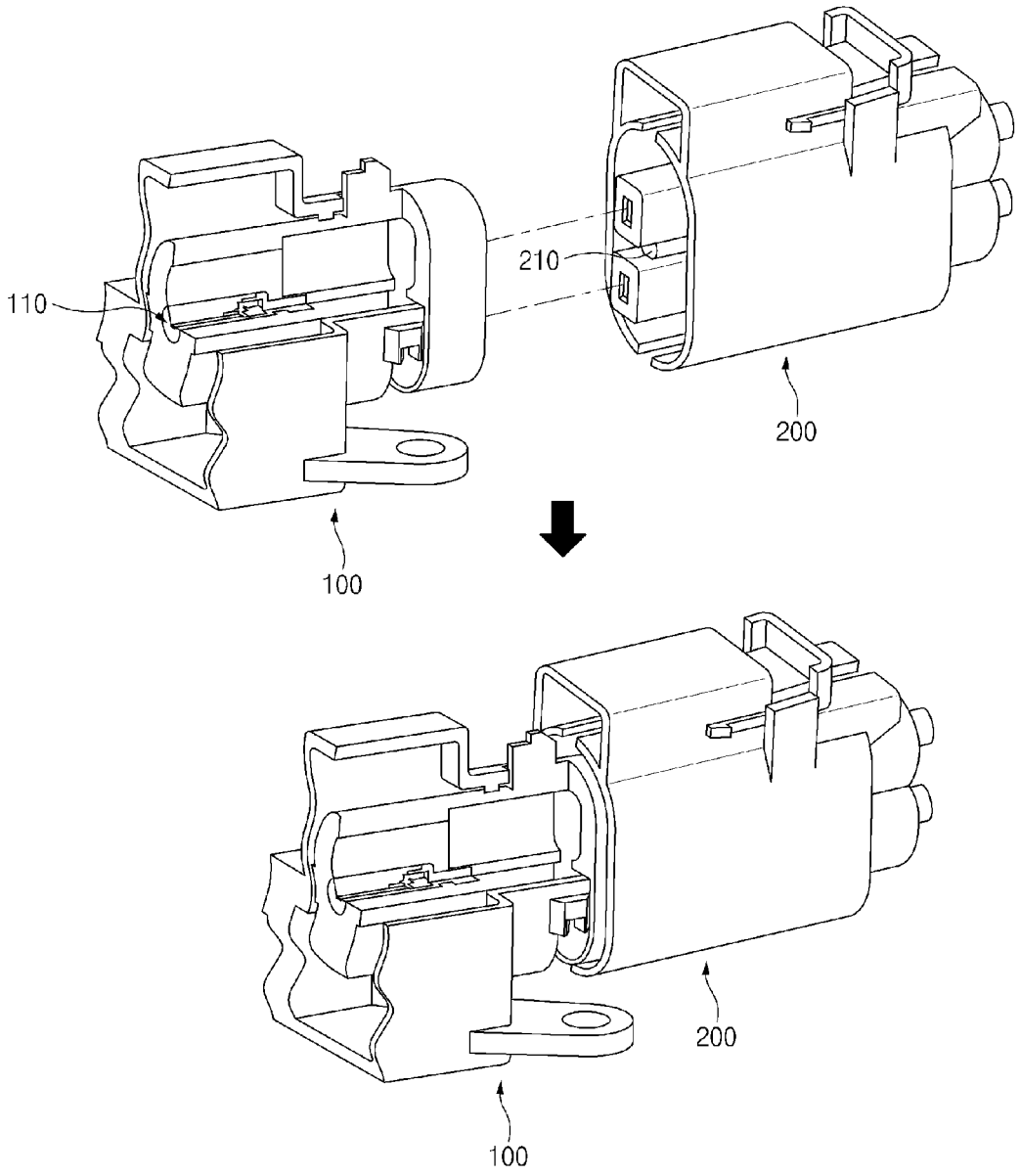
FIG. 1 is a view illustrating a first connector and a second connector of a high voltage connector for a vehicle according to the present disclosure.

Embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Referring now to the disclosed embodiments, a high voltage connector for a vehicle according to the present disclosure is configured to include a first connector 100 including an interlock switch part 110 and a second connector 200 pressing the interlock switch part 110 to control opening or closing of a high voltage transfer of the interlock switch part 110, as illustrated in FIGS. 1 to 8.

Figure 2:
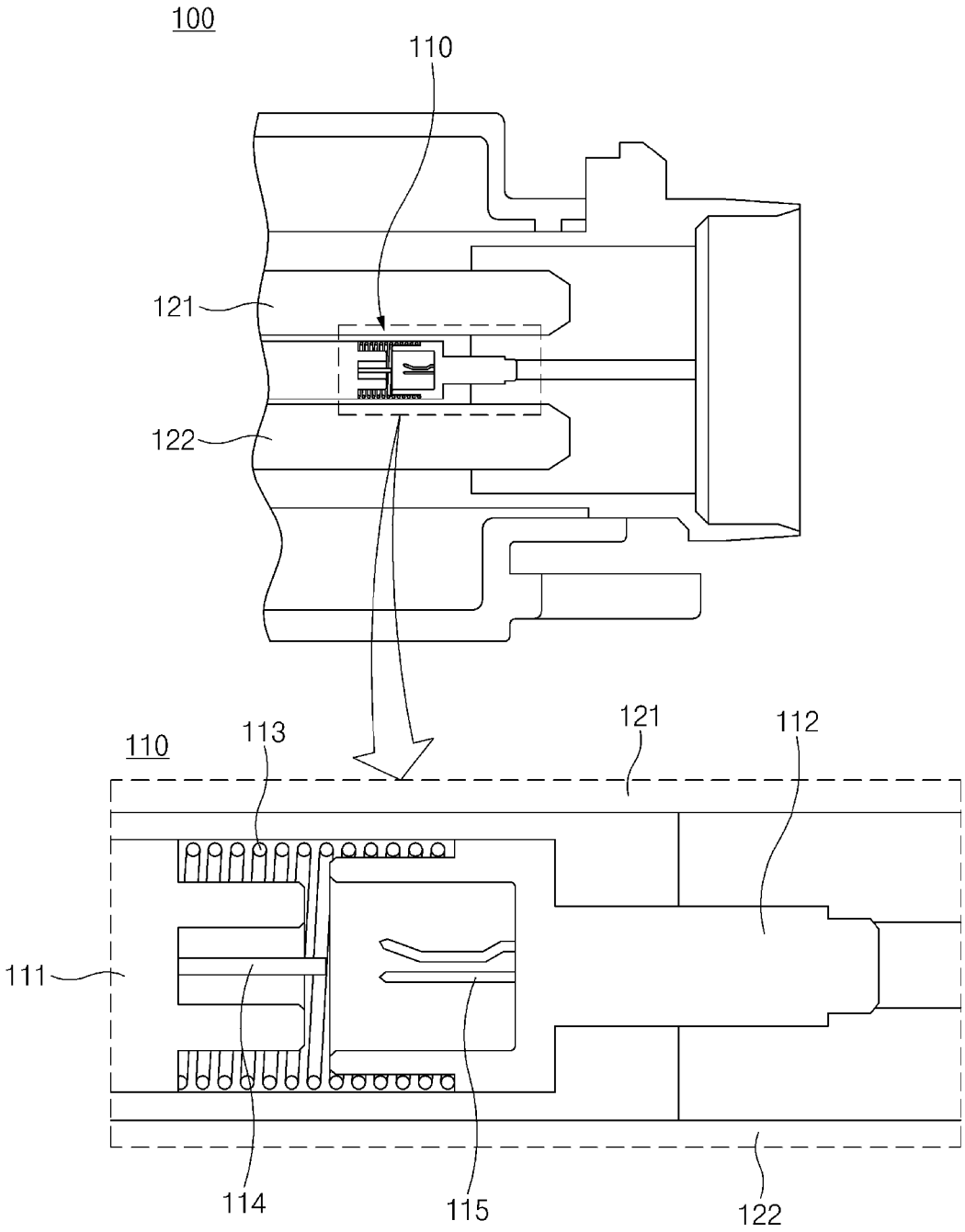
FIG. 2 is a view illustrating the first connector of the high voltage connector for a vehicle according to the present disclosure.

As illustrated in FIGS. 1 and 2, the first connector 100 is connected to a first wire inserted from the outside so as to transfer a current and configuring an interlock circuit to transfer the current, and includes the interlock switch part 110 discriminating an interlock signal to open or close a voltage transfer.

Figure 7:
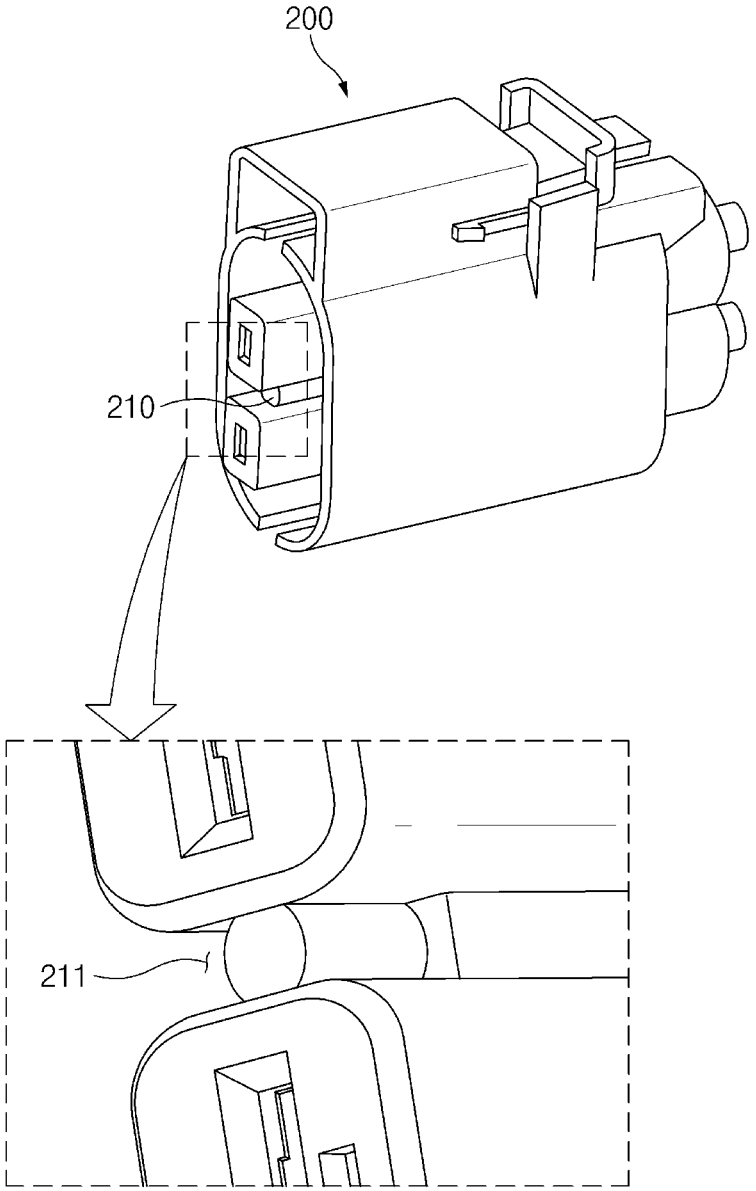
FIG. 7 is a view illustrating the second connector of the high voltage connector for a vehicle according to the present disclosure.

As illustrated in FIGS. 1 and 7, the second connector 200 is connected to a second wire inserted from the outside so as to transfer a current to transfer the current, and includes a pressing part 210 pressing a portion of the interlock switch part 110 of the first connector 100 to control the opening or closing of the voltage transfer of the interlock switch part 110. That is, the first connector 100 is a male connector, the second connector 200 is a female connector, and the first and second connectors 100 and 200 may be connected to each other.

Figure 4:
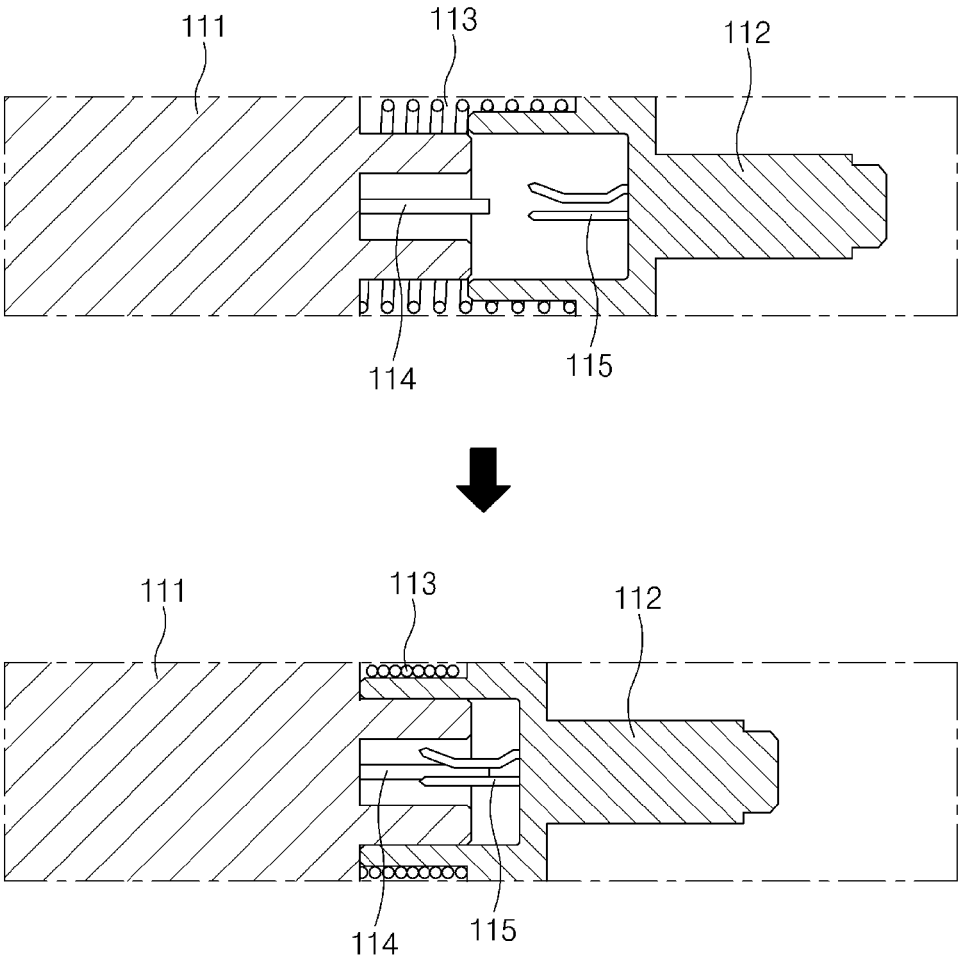
FIG. 4 is a cross-sectional view illustrating a state of an interlock switch before and after the first connector and the second connector of the high voltage connector for a vehicle according to the present disclosure are connected to each other.

As illustrated in FIGS. 2 and 4, the first connector 100 includes a first current terminal 121 and a second current terminal 122 that are disposed in a housing and transfer a large current. The large current transferred through the first and second current terminals 121 and 122 is not a current transferred from the first wire, but is a large current transferred from the second connector 200. Meanwhile, the large current may also be transferred from the first connector 100 including an interlock switch to the second connector 200.

The interlock switch part 110 is provided between the first and second current terminals 121 and 122 of the first connector 100, thereby making it possible to turn on/off an interlock system in a circuit form at the time of connecting the first and second connectors 100 and 200 to each other.

Figure 8:
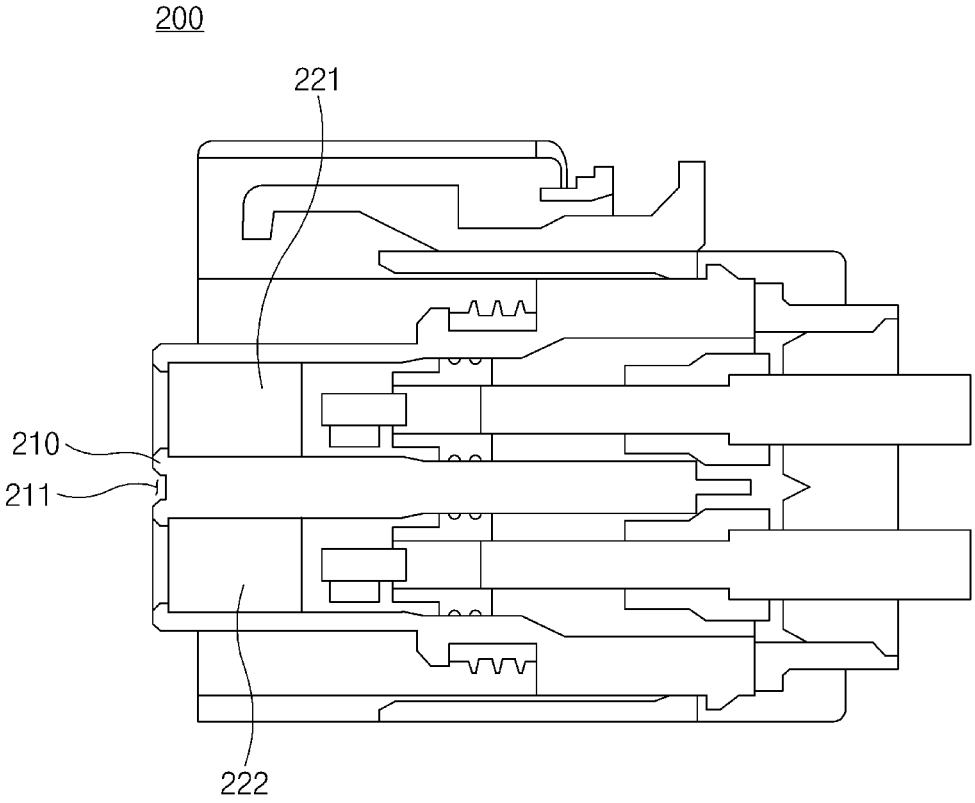
FIG. 8 is a cross-sectional view illustrating the second connector of the high voltage connector for a vehicle according to the present disclosure.

As illustrated in FIGS. 1, 7, and 8, the second connector 200 includes a first current connecting bar 221 and a second current connecting bar 222 contacting the first current terminal 121 and the second current terminal 122 formed in the first connector 100, thereby enabling the first connector 100 to transfer a current of the second connector 200 at the time of connecting the first connector 100 and the second connector 200 to each other.

Figure 5:
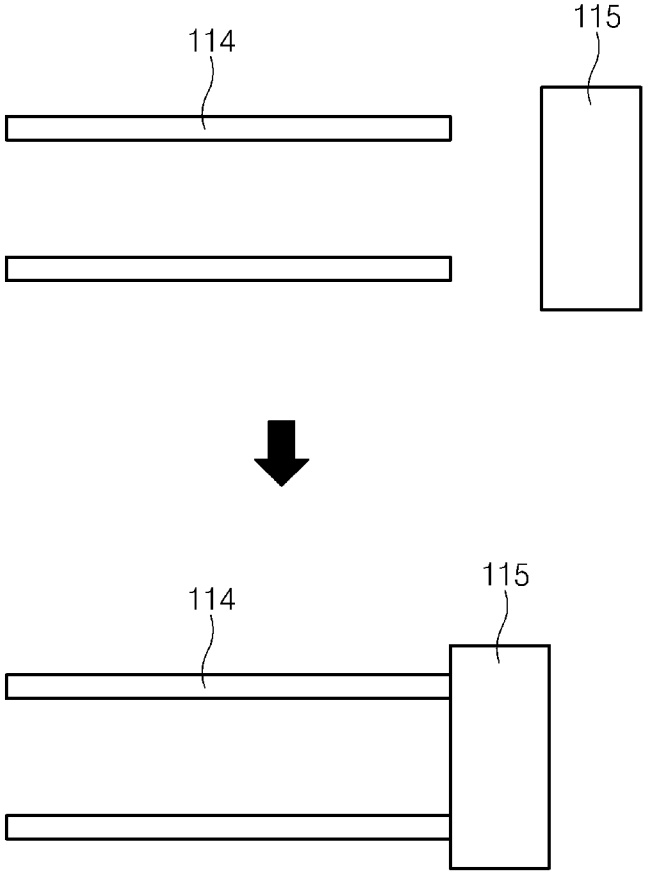
FIG. 5 is a cross-sectional view illustrating states of an interlock terminal and a short spring terminal before and after the first connector and the second connector of the high voltage connector for a vehicle according to the present disclosure are connected to each other.

Meanwhile, as illustrated in FIGS. 2, 4, and 5, the interlock switch part 110, which turns on/off the interlock system at the time of connecting the first connector 100 and the second connector 200 to each other, is configured to include a switch body 111 provided in the first connector 100 and connected to the first wire, a switch rod 112 provided at a front end of the switch body 111 so as to be movable by the pressing part 210 of the second connector 200, and a coil spring 113 connecting the switch body 111 and the switch rod 112 to each other.

Here, the front end of the switch body 111 is provided with an interlock terminal 114 transferring a voltage of the first wire and a rear end of the switch rod 112 is provided with a short spring terminal 115 into which the interlock terminal 114 is selectively inserted, such that the interlock circuit is not operated in the case in which the interlock terminal 114 is inserted into the short spring terminal 115 and the interlock circuit is operated in the case in which the interlock terminal 114 is not inserted into the short spring terminal 115.

In addition, it is preferable that a catching groove 211 is formed in the pressing part 210 to correspond to the switch rod 112. That is, when the first connector 100 and the second connector 200 are connected to each other, the pressing part 210 presses the switch rod 112 while the second connector 200 is inserted onto the first connector 100, thereby moving the switch rod 112. Therefore, the interlock terminal 114 is inserted into the short spring terminal 115 provided at the rear end of the switch rod 112, such that the interlock circuit is not operated. To the contrary, when the first connector 100 and the second connector 200 are disconnected from each other, the short spring terminal 115 is also disconnected from the interlock terminal 114, such that the interlock circuit is operated.

Figure 3:
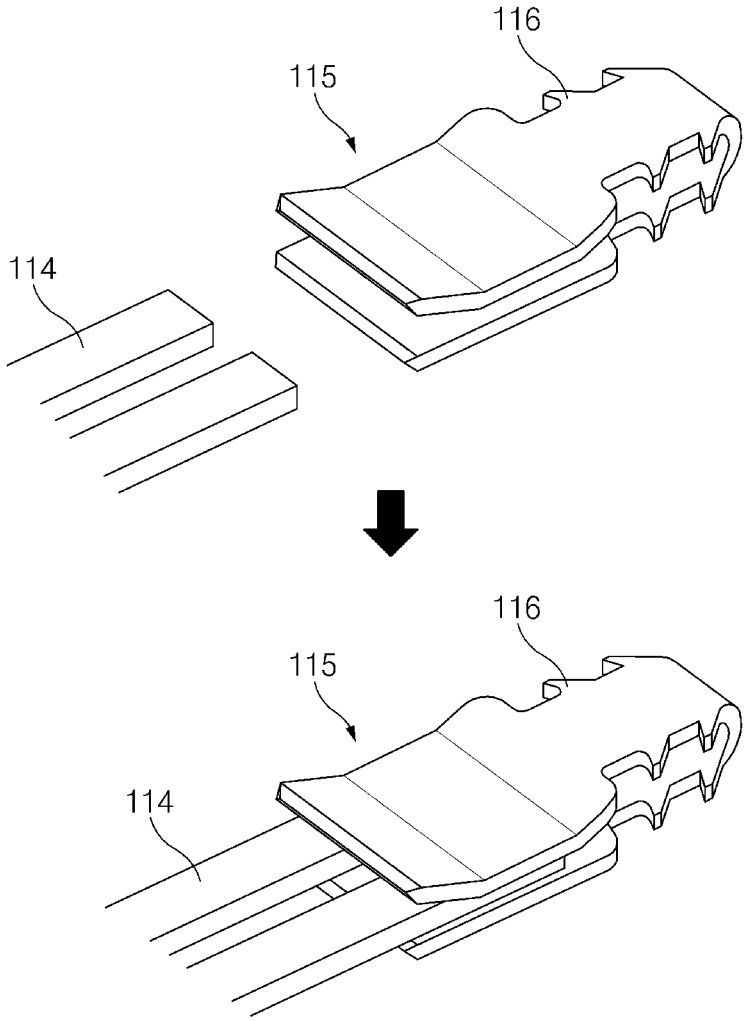
FIG. 3 is a view illustrating a short spring terminal of the high voltage connector for a vehicle according to the present disclosure.

Meanwhile, as illustrated in FIG. 3, the short spring terminal 115 has a shape of a leaf spring folded to have a predetermined gap, one end of the short spring terminal is fixed to the switch rod 112, and the other end thereof is opened to correspond to the interlock terminal 114, thereby making it possible to connect the interlock circuit by spring tension at the time of contacting the interlock terminal 114. In addition, a catching part 116 is formed at a folded portion of the short spring terminal 115 to prevent the short spring terminal 115 from being separated from the switch rod 112.

Figure 6:
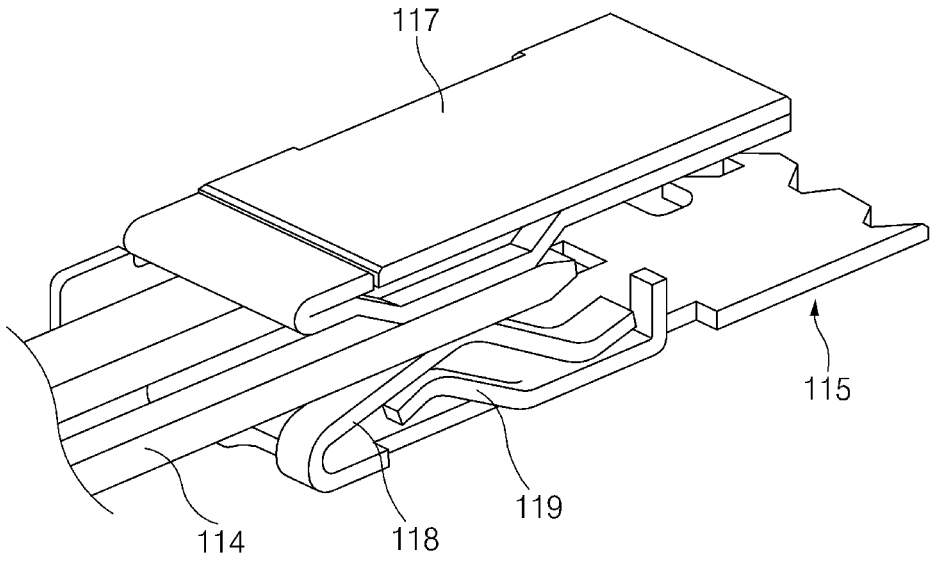
FIG. 6 is a view illustrating another example of a short spring terminal of the high voltage connector for a vehicle according to the present disclosure.

Meanwhile, as another example of the short spring terminal 115, as illustrated in FIG. 6, the short spring terminal 115 is a female terminal including a spring part 118 elastically contacting the interlock terminal 114 so as to correspond to the interlock terminal 114, a deformation preventing part 119 preventing deformation of the spring part 118, and a cover 117 formed outside the spring part 118 so as to protect the spring part 118 and having a box structure in which the spring part 118, the deformation preventing part 119, and the cover 117 are formed integrally with each other by repeatedly performing cutting and bending processes on a member having a plate shape several times.

The cover 117 is formed by repeatedly performing the cutting and bending processes on the member having the plate shape several times, and a catching part for preventing the cover 117 from being separated from the switch rod 112 is formed in the cover 117. In addition, the short spring terminal 115 prevents deformation of a spring, thereby making it possible to improve electrical and mechanical contact stability of the interlock system.

Figure 9:
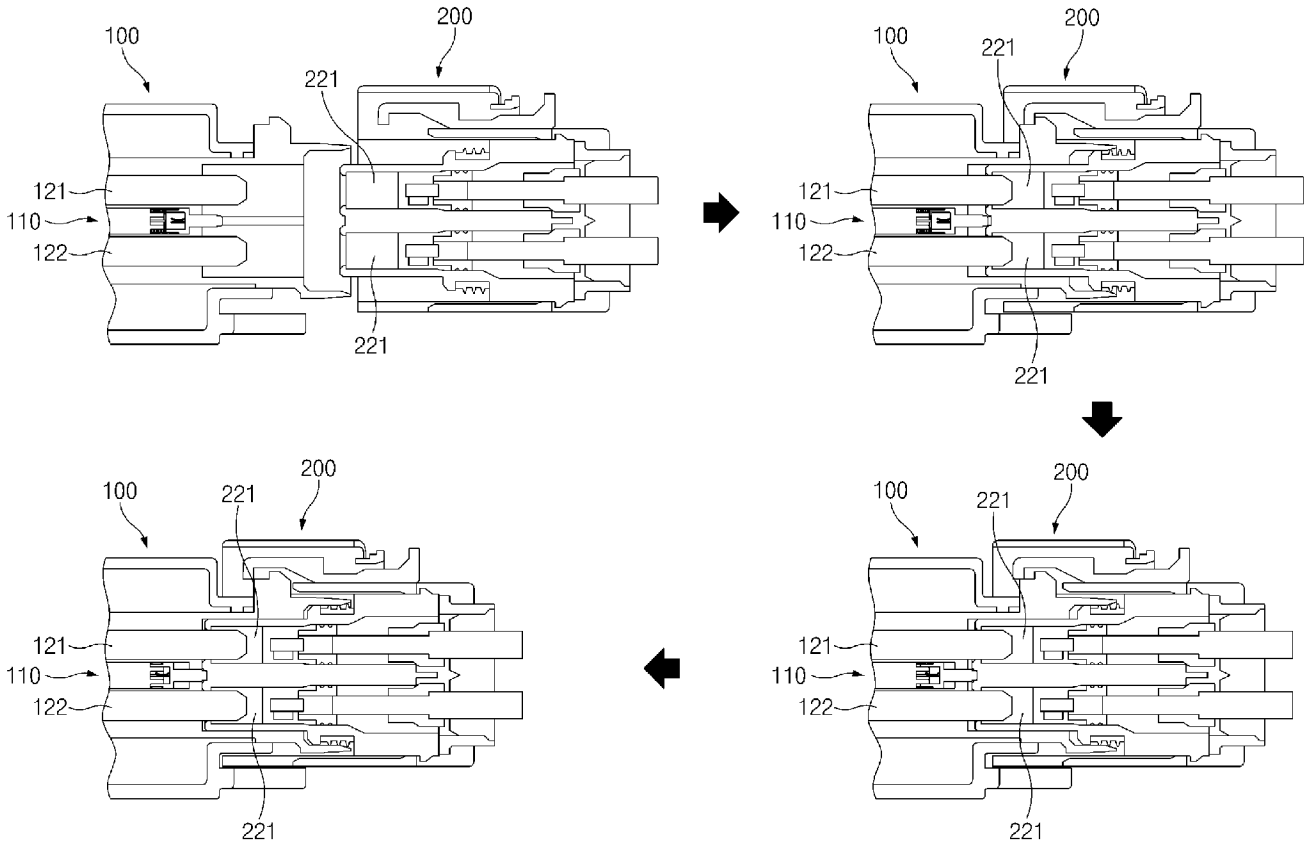
FIG. 9 is a cross-sectional view illustrating an operation sequence of an interlock system depending on connection between the first connector and the second connector in the high voltage connector for a vehicle according to the present disclosure.
Figure 10:
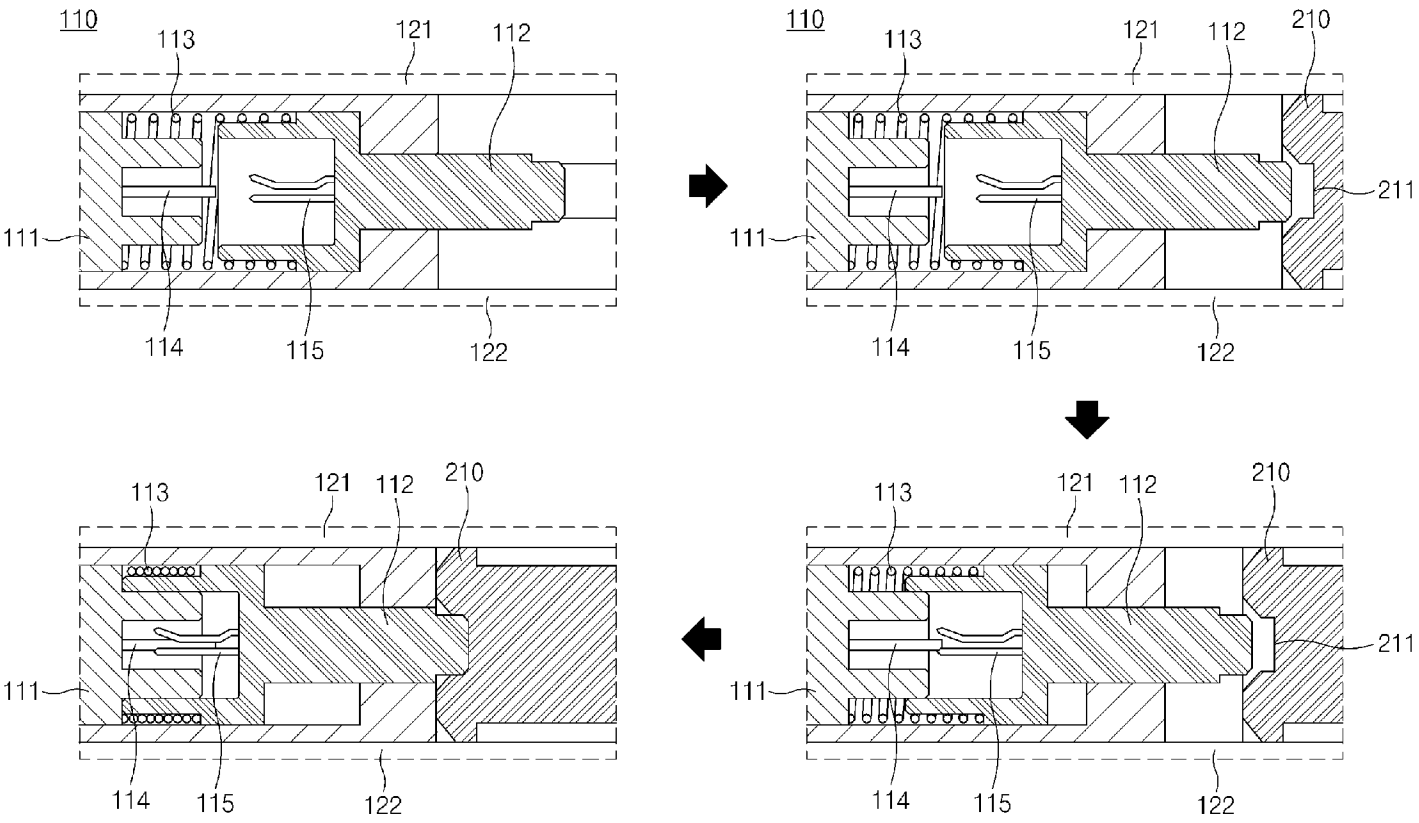
FIG. 10 is a cross-sectional view illustrating a state of an interlock switch depending on connection between the first connector and the second connector in the high voltage connector for a vehicle according to the present disclosure.

An operation sequence of the interlock system depending on connection between the first connector 100 and the second connector 200 in the present disclosure will be described. As illustrated in FIGS. 9 and 10, first (i.e., upper-left), a connection between the first connector 100 and the second connector 200 is prepared. In this case, the first current terminal 121 and the second current terminal 122 of the first connector 100 do not contact the first current connecting bar 221 and the second current connecting bar 222 of the second connector 200. Thus, an interlock contact is not made, such that the first connector 100 and the second connector 200 are in a high voltage and non-conducting state. Second (i.e., upper-right), when the second connector 200 are further connected to the first connector 100, the first current terminal 121 and the second current terminal 122 of the first connector 100 and the first current connecting bar 221 and the second current connecting bar 222 of the second connector 200 contact each other, but the interlock contact is not made, such that the first connector 100 and the second connector 200 are in the high voltage and non-conducting state. Third (i.e., lower-right), when the second connector 200 is further connected to the first connector 100, the first current terminal 121 and the second current terminal 122 of the first connector 100 and the first current connecting bar 221 and the second current connecting bar 222 of the second connector 200 completely contact each other, and the switch rod 112 and the pressing part 210 contact each other, such that high voltage conduction is prepared. Fourth (i.e., lower-left), when the second connector 200 is further connected to the first connector 100, the pressing part 210 presses the switch rod 112 in a state in which the first current terminal 121 and the second current terminal 122 of the first connector 100 and the first current connecting bar 221 and the second current connecting bar 222 of the second connector 200 completely contact each other, such that the interlock terminal 114 and the short spring terminal 115 are coupled to each other, thereby starting the high voltage conduction.

As described above, the high voltage connector for a vehicle according to the present disclosure includes the first connector 100 including the first current terminal 121 and the second current terminal 122 serving as a path of the current and the second connector 200 including the first current connecting bar 221 and the second current connecting bar 222 connected to the first current terminal 121 and the second current terminal 122, detachably connected to the first connector 100, and including the pressing part 210 protruding toward the first connector 100. The first connector 100 is provided with the interlock switch part 110 formed between the first current terminal 121 and the second current terminal 122 and moving by the pressing part 210 to open or close the voltage transfer of the first current terminal 121 and the second current terminal 122.

Therefore, the size, volume, and weight of the connector can be decreased. Because the decreased spatial margin is provided at the time of designing a vehicle package, marketability of the connector is improved. Further, a contact of the interlock terminal 114 is enabled in the first connector 100, thereby making it possible to protect the interlock circuit. Even further, a problem that a high voltage is blocked due to an unstable contact between the connectors is prevented, thereby additionally improving marketability and stability.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A high voltage connector for a vehicle, comprising:

a first connector connected to a first wire to transfer a current and including an interlock switch part controlling an interlock signal to open or close a voltage transfer; and a second connector connected to a second wire to transfer a current and including a pressing part pressing a portion of the interlock switch part of the first connector to control the opening or closing of the voltage transfer of the interlock switch part, wherein the first connector includes a first current terminal and a second current terminal that are disposed in a housing and transfer the current, wherein the interlock switch part is disposed between the first current terminal and the second current terminal, wherein a front end of a switch body is provided with an interlock terminal transferring a voltage of the first wire, wherein a rear end of a switch rod is provided with a short spring terminal into which the interlock terminal is selectively inserted, such that an interlock circuit is not operated when the interlock terminal is inserted into the short spring terminal, and the interlock circuit is operated when the interlock terminal is not inserted into the short spring terminal, wherein the interlock switch part includes:

the switch body connected to the first wire;

the switch rod provided at the front end of the switch body so as to be movable by the pressing part of the second connector; and a coil spring connecting the switch body and the switch rod to each other, and wherein one end of the short spring terminal is fixed to the switch rod, and another end of the short spring terminal is opened to correspond to the interlock terminal.

2. The high voltage connector for a vehicle according to claim 1, wherein the second connector includes a first current connecting bar and a second current connecting bar contacting the first current terminal and the second current terminal.

3. The high voltage connector for a vehicle according to claim 1, wherein:

the short spring terminal has a shape of a leaf spring folded to have a predetermined gap.

4. The high voltage connector for a vehicle according to claim 1, wherein a catching part is formed at a folded portion of the short spring terminal in order to prevent the short spring terminal from being separated from the switch rod.

5. The high voltage connector for a vehicle according to claim 1, wherein the short spring terminal includes:

a spring part elastically contacting the interlock terminal so as to correspond to the interlock terminal;

a deformation preventing part preventing deformation of the spring part; and a cover formed outside of the spring part so as to protect the spring part.

6. The high voltage connector for a vehicle according to claim 1, wherein a catching groove is formed in the pressing part to correspond to the switch rod.

7. The high voltage connector for a vehicle according to claim 1, wherein:

the first connector includes the first current terminal and the second current terminal serving as a path of a current, the second connector including includes the first current connecting bar and the second current connecting bar connected to the first current terminal and the second current terminal, detachably connected to the first connector, and including the pressing part protruding toward the first connector, and the first connector is provided with the interlock switch part formed between the first current terminal and the second current terminal and moving by the pressing part to open or close the voltage transfer of the first current terminal and the second current terminal.

8. A high voltage connector for a vehicle, comprising:

a first connector including an interlock switch part, a first current terminal, and a second current terminal, the first current terminal and the second current terminal being disposed in a housing and transferring a current, the interlock switch part including a switch body connected to a first wire, controlling an interlock signal to open or close a voltage transfer, and being disposed between the first current terminal and the second current terminal, wherein a switch rod is provided at a front end of the switch body so as to be movable, and a coil spring connects the switch body and the switch rod to each other; and a second connector connected to a second wire to transfer a current and including a first current connecting bar, a second current connecting bar, and a pressing part pressing a portion of the interlock switch part of the first connector to control the opening or closing of the voltage transfer of the interlock switch part, the first current connecting bar and the second current connecting bar contacting the first current terminal and the second current terminal, wherein the front end of the switch body is provided with an interlock terminal transferring a voltage of the first wire, wherein a rear end of the switch rod is provided with a short spring terminal into which the interlock terminal is selectively inserted, which that an interlock circuit is not operated when the interlock terminal is inserted into the short spring terminal, and the interlock circuit is operated when the interlock terminal is not inserted into the short spring terminal, wherein the short spring terminal has a shape of a leaf spring folded to have a predetermined gap, and wherein one end of the short spring terminal is fixed to the switch rod and another end of the short spring terminal is opened to correspond to the interlock terminal.

9. The high voltage connector for a vehicle according to claim 8, wherein a catching part is formed at a folded portion of the short spring terminal in order to prevent the short spring terminal from being separated from the switch rod.

10. The high voltage connector for a vehicle according to claim 8, wherein the short spring terminal includes:

a spring part elastically contacting the interlock terminal so as to correspond to the interlock terminal;

a deformation preventing part preventing deformation of the spring part; and a cover formed outside of the spring part so as to protect the spring part.

11. A high voltage connector for a vehicle, comprising:

a first connector connected to a first wire to transfer a current and including an interlock switch part controlling an interlock signal to open or close a voltage transfer; and a second connector connected to a second wire to transfer a current and including a pressing part pressing a portion of the interlock switch part of the first connector to control the opening or closing of the voltage transfer of the interlock switch part, wherein the first connector includes a first current terminal and a second current terminal that are disposed in a housing and transfer the current, and wherein the interlock switch part is disposed between the first current terminal and the second current terminal, wherein a front end of a switch body is provided with an interlock terminal transferring a voltage of the first wire, wherein a rear end of a switch rod is provided with a short spring terminal into which the interlock terminal is selectively inserted, such that an interlock circuit is not operated when the interlock terminal is inserted into the short spring terminal, and the interlock circuit is operated when the interlock terminal is not inserted into the short spring terminal, wherein the interlock switch part includes:

the switch body connected to the first wire;

the switch rod provided at the front end of the switch body so as to be movable by the pressing part of the second connector; and a coil spring connecting the switch body and the switch rod to each other, and wherein the short spring terminal includes:

a spring part elastically contacting the interlock terminal so as to correspond to the interlock terminal;

a deformation preventing part preventing deformation of the spring part; and a cover formed outside of the spring part so as to protect the spring part.

* * * * *